United States Patent [19]

Norton et al.

[11] 4,286,109

[45] Aug. 25, 1981

[54] HIGH DENSITY FUEL COMPOSITIONS

[75] Inventors: Richard V. Norton, Dublin; Dennis H. Fisher, Westerville, both of Ohio

[73] Assignee: Ashland Oil, Inc., Ashland, Ky.

[21] Appl. No.: 174,078

[22] Filed: Jul. 31, 1980

[51] Int. Cl.[3] ..... C10L 1/04

[52] U.S. Cl. ..... 585/14; 585/253; 585/362; 585/22; 149/109.4; 149/120

[58] Field of Search ..... 585/14, 22, 253, 362; 149/109.4, 120

[56] References Cited

U.S. PATENT DOCUMENTS

| | | | |
|---|---|---|---|
| 3,381,046 | 4/1968 | Cohen | 585/22 |
| 4,059,644 | 11/1977 | Cannell | 585/14 |
| 4,086,286 | 4/1978 | Janoski et al. | 585/14 |
| 4,177,217 | 12/1979 | Janoski et al. | 149/109.4 |

*Primary Examiner*—Patrick Garvin
*Assistant Examiner*—J. V. Howard
*Attorney, Agent, or Firm*—William Kammerer

[57] ABSTRACT

A high density specialty fuel for propelling limited volume ramjet and turbojet missile systems comprising a blend of at least 70 weight percent of exotetrahydrodicyclopentadiene and a correspondingly minor amount of a combination of a $C_5$–$C_7$ alkane or cycloalkane and a tetrahydro derivative of the trimer and/or co-trimer of cyclopentadiene and methylcyclopentadiene.

6 Claims, No Drawings

HIGH DENSITY FUEL COMPOSITIONS

BACKGROUND OF THE INVENTION

1. Field of the Invention

This invention relates to synthetically derived high density liquid hydrocarbon fuels.

2. Description of the Prior Art

High density liquid hydrocarbon fuels are characterized in having a net volumetric heat of combustion in excess of about 140,000 BTU per gallon. A high density or energy fuel is essentially required for fueling turbojet and ramjet propelled limited volume missile systems. Beyond the need for a high energy content in order to maximize range performance of the missile, there are other requirements in the forefront depending, in the main, on the manner in which the missile is to be deployed. For instance, in the air-borne deployment of a missile where the latter is carried exteriorly of the aircraft, the fuel must exhibit the combination of a very low freeze point and high volatility.

A high density fuel of the foregoing type does not occur in nature but rather must be chemically synthesized. Essentially all of the current generation of such fuels commonly feature a norbornane moiety having an additional cyclic hydrocarbon appendage. Such appendages include the norbornane structure itself in the case of the most exotic of these fuels designated RJ-5, derived from dihydro di (norbornadiene). In some instances only a specific stereo isomer of the synthesized compound represents a suitable fuel from the standpoint of having the requisite physical properties. A notable example of this is JP-10 which chemically is the exostereo isomer of tetrahydrodicyclopentadiene.

In missile launching situations calling a low temperature operational capability as noted above, the preeminent fuel of choice is said JP-10. This is so because JP-10 is derived from abundantly available raw materials coupled with the comparative ease of preparing a given chemical species as opposed to preparing complex mixtures thereof with attendant reproducibility problems. There is, however, a serious drawback to the use of JP-10 in the instant context insofar as it possesses relatively low volatility thereby resulting in an unacceptably high flash point of about 130° F. For the indicated low temperature operations, a flash point of less than 100° F. and preferably substantially less than this value is sought.

The foregoing volatility requirement has been met by a fuel designated JP-9, same being a blend of 65–70 weight percent JP-10, 20–25 weight percent RJ-5 and 10–12 weight percent methylcyclohexane. Methylcyclohexane serves to impart the necessary volatility characteristics to JP-10, so that an acceptable flash point can be realized. However, this low density component is required in an amount which undesirably lowers the volumetric heat of combustion of JP-10. Therefore, it is necessary to include the indicated amount of RJ-5 in order to achieve an overall volumetric heat of combustion in the order of that exhibited by neat JP-10.

As mentioned previously, RJ-5 is the most exotic of the current high density fuels in that it possesses a heat of combustion in excess of 160,000 BTU per gallon. It is, however, extremely expensive due in part to the difficulty in synthesizing the fuel and in a large part to the short supply of the precursor, norbornadiene, from which it is prepared. It is accordingly the object of the present invention to provide a high density fuel conforming to the specifications established for JP-9 but which does not require the use of RJ-5 as a blend stock component.

SUMMARY OF THE INVENTION

In accordance with the present invention, specialty high density fuel blends are provided having the specifications established for JP-9 in respect of heat content, freeze point, viscosity and volatility. The principal component of the contemplated fuels is JP-10 (exo-tetrahydrodicyclopentadiene) which is present in the blend in an amount of at least 70 weight percent. The requisite volatility is imparted to the blend by the presence of 1–7 weight percent of a $C_5$–$C_7$ alkane or cycloalkane and including mixtures thereof. The lowering of the net heat of combustion resulting from the inclusion of said low density component; i.e., said alkane or mixture thereof, is offset or compensated for by the presence of from 4–25 weight percent of the overall blend of a tripartite oligomer of cyclopentadiene and/or methylcyclopentadiene. An important aspect of the invention concerns the use of a forecut fraction of a reaction mixture obtained in preparing JP-10 or said oligomer as the volatility modifying component of the blend.

DESCRIPTION OF THE PREFERRED EMBODIMENTS

As indicated previously, JP-10 is a commercially available product. However, for a more complete understanding of the best mode contemplated for carrying out the present invention, it will be desirable to comment briefly on the method applicable for producing this fuel. Further details regarding this process can be found in U.S. Pat. No. 3,381,046. The first step involved is that of completely hydrogenating dicyclopentadiene to provide the endo-stereo isomer of the tetrahydro derivative. Generally hydrogenation is carried out in two stages. In the first stage the 8, 9 positions of the dimerized product are hydrogenated at a temperature generally in the order of about 120° C. The dihydro derivative is relatively thermally stable, thus permitting the use of a substantially higher temperature in the second stage; viz., in the order of about 215° C. Hydrogenation is carried out in the second stage to the extent whereby the resultant tetrahydro derivative exhibits a melting point of at least about 70° C. Hydrogenation pressure conditions range from about 5–15 atmospheres.

In the second step of the process the endo isomer of the tetrahydro derivative is isomerized to the exo form. The crude hydrogenation product or an appropriate distilled fraction thereof, rich in the exo-isomer content, can alternatively be subjected to isomerization in accordance with the prior art. In the context of the present invention, however, it is advantageous to utilize the total crude hydrogenation product in the isomerization reaction. The reason for this preference will be noted hereinbelow. The isomerization is carried out in the presence of a variety of acidic catalysts such as the Brönsted or Lewis acids. The Lewis acids and specifically aluminum chloride, is preferred from the standpoint of inducing a rapid reaction rate. On the other hand, aluminum chloride has a tendency to cause the isomerization to proceed beyond the exo isomer thereby resulting in the objectionable formation of substantial amounts of transdecalin and adamantane. Accordingly, due care must be exercised in the utilization of this catalyst.

The extent of conversion to the exo isomer can be conveniently monitored by vapor liquid gas chromatography. Upon attaining substantially complete conversion; i.e., 98+%, the reaction mixture is cooled to about 80° C. to provide, upon settling, a two-phase system thereby permitting recovery of the fuel from the sludge by decantation. The product is then fractionally distilled to provide a heartcut which consists essentially of the exo isomers. If the crude hydrogenation product is employed in effecting the isomerization reaction, a forecut of the isomerization reaction product will be essentially composed of isomeric pentanes with the major portion thereof; i.e., about 70 percent, being cyclopentane. This forecut represents an effective volatility modifier in accordance with this invention and is preferred for this purpose. In addition, other alkanes suitable for use in the practice of this invention are the various isomers of hexane and heptane including mixtures thereof with the JP-10 forecut noted above.

The third component of the fuel compositions contemplated herein is the high energy fuel obtained by hydrogenating a Diels-Alder co-trimer of cyclopentadiene and methylcyclopentadiene. Complete details concerning a method applicable for preparing such trimers are set forth in U.S. Pat. No. 4,059,644. Basically the method involved consists of effecting the partial in situ dissociation of a mixture of dimers of cyclopentadiene and methylcyclopentadiene to their respective monomers which then in turn randomly adduct with dimers present in the reaction mixture to provide a trimerization product. The resultant reaction mixture can be hydrogenated directly or alternatively, the co-trimers can be recovered from the reaction mixture and hydrogenated to provide the high energy fuel. The resultant fuel exhibits a volumetric heat of combustion in excess of 150,000 BTU per gallon.

One can also advantageously utilize the general procedure taught in U.S. Pat. No. 4,059,644 in order to prepare the trimer of cyclopentadiene or methylcyclopentadiene. These trimers do not in themselves represent a suitable high density missile fuel because of their relatively high freeze point and viscosity. However, they are useful in the practice of this invention in view of the amounts thereof required to offset the heat content dilution contributed by the indicated volatility modifiers. Accordingly, these amounts do not substantially alter the overall freeze point and viscosity characteristics of the blended composition because of the sizeable content of the JP-10 component.

EXAMPLE I

The purpose of this example is to illustrate the preparation of a co-trimer of cyclopentadiene and methylcyclopentadiene useful in the practice of this invention. The method utilized in preparing the co-trimer is in accordance with the teachings of U.S. Pat. No. 4,059,644. To a gallon autoclave were charged 1350 grams of dicyclopentadiene, 1650 grams of methylcyclopentadiene dimer and 3 grams of BHT (butylated hydroxytoluene). The reactants were held at 210° C. for one hour and then completely hydrogenated at a temperature of 150° C. and a hydrogen pressure of 10 atmospheres in the presence of a standard of hydrogenation catalyst. The resultant product was then distilled to provide 475 grams of a forecut and 942 grams of a heartcut (co-trimer) and 1043 grams of polymeric residues.

A similar procedure to the above was employed to prepare a tetrahydro derivative of a trimer of cyclopentadiene in which case the reactant was dicyclopentadiene.

EXAMPLE II

This example is illustrative of specialty high density fuel blends prepared in accordance with the present invention. The composition of these various blends together with the relevant properties thereof for use as a missile fuel are set forth in the following Table 1.

TABLE 1

| | A | B | C | D | E | F | G |
|---|---|---|---|---|---|---|---|
| Composition | | | | | | | |
| Wt. % JP-10 | 85 | 80 | 75 | 90 | 92.5 | 95 | 89.2 |
| Wt. % Co-trimer (Example I) | 12 | 16 | 20 | 8 | 6 | 4 | — |
| Wt. % Tetrahydrocyclopentadiene Trimer (Example I) | — | — | — | — | — | — | 8.0 |
| Wt. % $C_5$ Hydrocarbons (>70% cyclopentadiene) | 3 | 4 | 5 | 2 | 1.5 | 1 | — |
| Wt. % $C_5$–$C_7$ Hydrocarbons | — | — | — | — | — | — | 2.8 |
| Viscosity | | | | | | | |
| At ° F. | 9.66 | 10.28 | 10.40 | 9.077 | 8.839 | 8.616 | — |
| −25° F. | 15.80 | 17.05 | 17.41 | 13.078 | 14.185 | 12.23 | — |
| −65° F. | 45.30 | 50.81 | 62.03 | 40.12 | 41.905 | 37.726 | 37.73 |
| $\Delta H_C$ at 25° C. | | | | | | | |
| Gross BTU/lb. | 19,279 | 19,285 | 19,261 | 19,237 | 19,182 | 19,156 | 19.280 |
| Calculated % $H_2$ | 11.285 | 11.820 | 11.815 | 11.830 | 11.832 | 11.835 | 11.859 |
| Net BTU/lb ($\Delta H_C$) | 18.200 | 18,207 | 18,183 | 18,103 | 18,103 | 18,076 | 18,198 |
| Specific Gravity (60° F./60° F.) | 0.940 | 0.940 | 0.943 | 0.942 | 0.940 | 0.940 | 0.938 |
| BTU/gal. at 25° C. | 142,295 | 142,347 | 142,613 | 142,570 | 142,100 | 142,075 | 142,230 |
| SETA FLASH POINT (°F.) | 42 | <33 | <35 | 70 | 82 | 94 | 64 |

[1] $\Delta H_C net = \Delta H_C gross - 91.23 \times$ wt. % $H_2$

| Average wt. % $H_2$ in: | | |
|---|---|---|
| | TH-CPD trimer | 10.96% |
| | Co-trimer | 11.08% |
| | JP-10 | 11.84% |
| | Cyclopentane | 14.37% |
| | Co-dimer | 12.105% |

What is claimed is:

1. A high density fuel composition consisting essentially of (a) from 70–95 weight percent of exo-tetrahydro dicyclopentadiene; (b) from 4–25 weight percent of the tetrahydro derivative of an oligomer selected from the group consisting of a co-trimer of cyclopentadiene and methylcyclopentadiene, a trimer of cyclopentadiene, a trimer of methylcyclopentadiene, and mixtures thereof; and (c) from 1–7 weight percent of a $C_5$–$C_7$ alkane, cycloalkane or mixtures thereof.

2. A high density fuel composition according to claim 1 wherein said oligomer is a co-trimer of cyclopentadiene and methylcyclopentadiene.

3. A high density fuel composition according to claim 1 wherein said oligomer is the trimer of cyclopentadiene.

4. A high density fuel composition according to claim 1 wherein said oligomer is the trimer of methylcyclopentadiene.

5. A high density fuel composition according to claim 2, 3, or 4 consisting essentially of from 85–91 weight percent of (a); from 7–12 weight percent of (b); and from 2–3 weight percent of (c).

6. A high density fuel composition according to claim 5 wherein said component (c) is a mixture of isomeric pentanes containing a major amount of cyclopentane.

* * * * *